United States Patent [19]

Berkowitz

[11] 4,193,504

[45] Mar. 18, 1980

[54] HANGER FOR HANGING FABRIC

[76] Inventor: Milton Berkowitz, 500 E. 85 St., New York, N.Y. 10028

[21] Appl. No.: 890,923

[22] Filed: Mar. 28, 1978

Related U.S. Application Data

[63] Continuation of Ser. No. 668,928, Mar. 22, 1976, abandoned.

[51] Int. Cl.[2] ..... A47F 7/00

[52] U.S. Cl. ..... 211/119; 211/45; 211/59.1

[58] Field of Search ..... 211/119, 113, 125, 54.1, 211/57.1, 59.1, 45; 248/339, 340, 341; 223/85; 206/11, 279, 289, 296; 160/404

[56] References Cited

U.S. PATENT DOCUMENTS

| | | | |
|---|---|---|---|
| 1,143,193 | 6/1915 | Hannon | 211/125 |
| 1,711,070 | 4/1929 | Suydam | 211/59.1 X |
| 1,788,722 | 1/1931 | Koebler | 248/340 |
| 1,865,039 | 6/1932 | Packard | 38/102.1 |
| 2,230,480 | 2/1941 | Blanc | 211/119 |
| 2,294,607 | 9/1942 | Peck et al. | 211/119 X |
| 2,931,547 | 4/1960 | Dick | 211/119 X |
| 3,171,577 | 3/1965 | Lindegren | 211/119 X |
| 3,720,324 | 3/1973 | Berkowitz | 211/113 X |

FOREIGN PATENT DOCUMENTS

| | | | |
|---|---|---|---|
| 1067730 | 6/1954 | France | 211/113 |
| 1162923 | 9/1969 | United Kingdom | 223/85 |

*Primary Examiner*—Ramon S. Britts
*Assistant Examiner*—Robert W. Gibson, Jr.
*Attorney, Agent, or Firm*—Kenyon & Kenyon

[57] ABSTRACT

A hanger for hanging fabric in pendent, vertical form is disclosed. More specifically, the hanger comprises a longitudinally extending main member which is supported by an attachment means and which has similarly configured securing units at its opposite ends. Each of the latter units includes a support member affixed to the main member and a mounting member attached to the support member. In accord with the invention, each mounting member has a free end portion adapted for piercing fabric which extends toward and is adjacent to its respective support member and/or the main member. Also, in accord with the invention, the attachment means, which is to hold the main member in substantially horizontal disposition upon engagement with a rail member, is configured such that the region of engagement is offset from the vertical plane which includes the main member.

In a further aspect of the invention, packages for securely transporting the hanger are also disclosed.

7 Claims, 5 Drawing Figures

HANGER FOR HANGING FABRIC

This is a continuation, of application Ser. No. 668,928 filed Mar. 22, 1976, now abandoned.

BACKGROUND OF THE INVENTION

This invention relates to a hanger for fabric and, more particularly, to a hanger for hanging piece length fabrics in pendent, vertical form.

It is often necessary for retailers who handle fabric which is susceptible to crushing, such as, for example, velvet, to store such fabric on hangers capable of supporting the fabric in pendent, vertical form. A variety of hangers have heretofore been employed for this purpose.

In many of these hangers a rigid, horizontal main bar is employed to support similarly configured securing units which function to hold the fabric and which are affixed to opposite ends of the main bar by respective support members included in the units. The fabric is attached to the securing units via mounting members which have sharply pointed outwardly extending free ends for piercing the top selvedge of the fabric. Unfortunately, once the fabric is fully hung, the aforesaid pointed ends of the mounting members, having pierced through the fabric, now remain exposed, thereby constituting a danger to anyone who comes within the vicinity of the hanger.

In order to obviate this danger, the designers of these hangers have included additional members, e.g., slidably mounted safety bars in the securing units to act as shields for the exposed pointed ends of the mounting members. Unfortunately, the addition of these shielding members has increased the complexity and cost of the hangers, thereby lessening their attractiveness to potential purchasers.

It is, therefore, a primary object of the present invention to provide a hanger having securing units whose mounting members have their pointed free ends shielded in a manner which precludes having to include additional shielding members in such units.

SUMMARY OF THE INVENTION

In accordance with the principles of the present invention, the above and other objectives are realized in a hanger comprising a main member at whose opposite ends are disposed securing units each of which includes a support member for affixing the unit to the main member and a mounting member affixed to such support member and having a pointed free end disposed substantially perpendicular to the support members such that it is shielded by the support member and/or by the main member of the hanger. Since the pointed free ends of the mounting members are now shielded by the already existing support members and/or the already existing main member, the need for additional members to provide this function is no longer necessary.

More particularly, in accordance with the invention, each mounting member is configured so as to first extend outwardly from its respective support member. Thereafter, each mounting member extends such that the pointed free end of the member is directed toward; is adjacent to its respective support member or the main member and is substantially perpendicular to the support member.

In further accord with the invention, the hanger further includes an attachment means which is connected to the main member and which supports the main member in substantially horizontal disposition, and so as to prevent the member from rotating due to the fabric secured to the securing units at its ends. Specifically, the attachment means is adapted to engage a support member, such as a rail, such that the region of engagement is offset from the vertical plane which includes the main member.

In the illustrative embodiment to be described hereinafter, the main member of the hanger comprises a longitudinally extending rigid bar having an attachment means which includes a hook and a horizontal member, the latter member being attached at one end to the base of the hook and at the other end to the midpoint of the rigid bar. The support members of the securing units are affixed to the opposite longitudinal ends of the main member and each comprises a rigid rod which extends transversely from the main member. Each mounting member is also in the form of a rigid bar and each has one end affixed to the unattached end of its respective support member and its other free end adapted for piercing fabric via a pin included at such end. Moreover, each such rigid bar forming a mounting member extends downwardly from its respective support member and, thereafter, upwardly in curved fashion so that the pin at its free end is directed toward and disposed under such support member or the main member and is substantially perpendicular to the support member.

In a further aspect of the invention, the hanger is associated with a package for transporting the hanger and the supported fabric so that the latter is not crushed or disturbed during transportation. More particularly, the package includes a support member for supporting the attachment means of the hanger and a securing member for securing the bottom selvedge of the supported fabric. Two specific embodiments of such a package are described hereinbelow, one of which can be employed to transport a single hanger and the other of which can be employed to transport a plurality of hangers.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
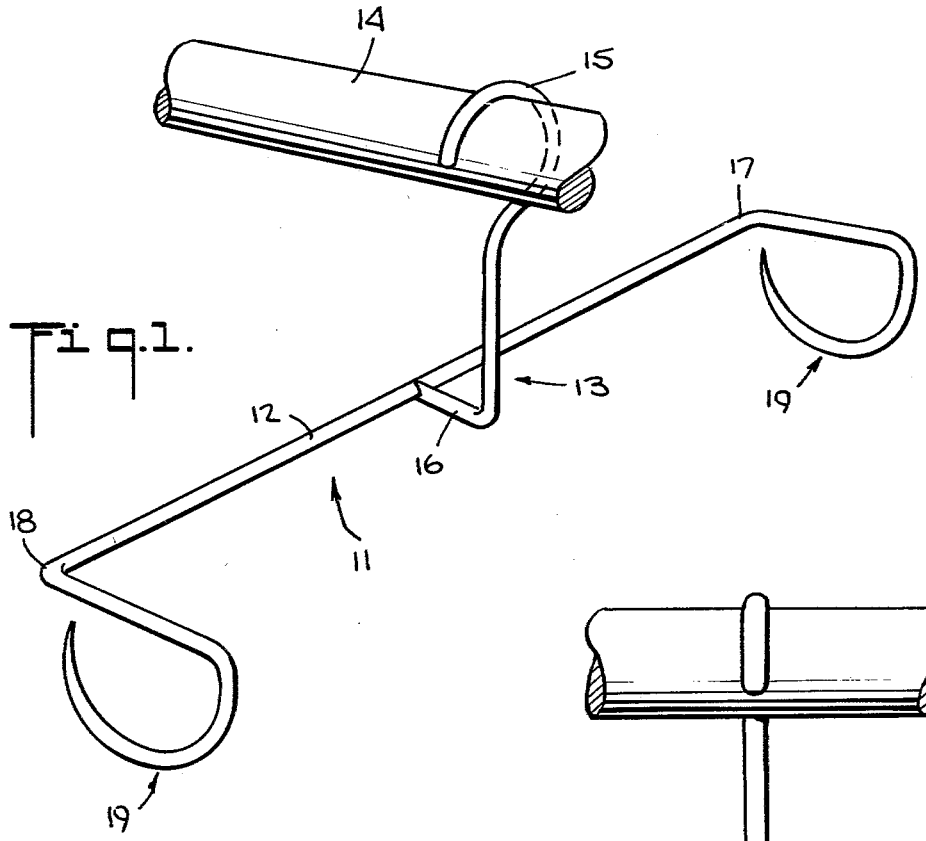
FIG. 1 illustrates a perspective view of a hanger for hanging fabric in accordance with the principles of the present invention.

In FIG. 1 a hanger 11 in accordance with the principles of the present invention is shown. As illustrated, hanger 11 comprises a rigid, straight longitudinally extending main member 12 having an attachment means 13 disposed substantially at its center. The latter attachment means is adapted to be fastened to a horizontal rail, such as rail 14, whereby the main member 12 is supported in substantially horizontal disposition. More specifically, the attachment means 13 includes a hook 15 for engagement with rail 14 and a support member 16. The latter member 16 supports the hook 15 and extends from the base thereof to the center of the main member 12. Further details regarding the attachment means 13 will be discussed hereinbelow.

Disposed at opposite end portions 17 and 18 of member 12 are similarly configured securing units 19 which are adapted to permit fabric to be secured to hanger 11 in pendent, vertical fashion. More specifically, as seen more clearly in FIG. 2, each securing unit 19 comprises a support member in the form of a straight, rigid rod 21 which is affixed at one of its ends to a respective longitudinal end of the member 12. As shown, the rigid rod 21 extends transversely and at a substantially 90° angle from the member 12.

Attached to the other end of rigid rod 21 is a mounting member which is in the form of a curved, rigid bar 22. The bar 22 at its free end 23 is adapted for piercing fabric by forming the end as a pin having its upper portion sharpened to a point.

As can be seen, the bar 22 extends downwardly from the member 21 and, thereafter, upwardly so that the pointed free end 23 is disposed substantially perpendicular to the support member 21 and is adjacent to the underside of the member 21. As can be appreciated, such positioning of the pointed end 23 causes the member 21, in addition to acting as a support, to also act as a shield for such pointed end.

To attach fabric to the hanger 11 the selvedge of the piece length of fabric is spiked over the pointed ends 23 as the fabric is moved back and forth between the ends of the hanger. The ends 23 pierce and pass through the fabric holding it on the looped portions of the mounting members 22 so that the hanger supports the fabric in pendent, vertical fashion. Moreover, while the ends 23 have passed through the fabric in order to secure it to the hanger, they nonetheless do not remain exposed due to the shielding effect of the support members 21. Thus, the hanger can be freely moved without concern or worry about the ends 23 causing injury.

As can be appreciated, the mounting members 22, the support members 21, the main bar 12 and the attachment means 13 can be formed from a single continuous member by suitably bending such member. As can also be appreciated, the particular curvature of the mounting members 22 and the proximity of the ends 23 to the bars 21 will depend, amongst other things, upon the characteristics of the fabric being hung. In general, the spacing of the ends 23 from their respective bars 21 should be at least sufficiently great to permit the fabric to be spiked over the ends for attachment to the hanger. The curvature of the members 22, on the other hand, should be such as to reduce the tendency of the hanger to rotate when supported on rail 14.

In accord with the invention, the aforesaid tendency of the hanger 11 to rotate or cant with respect to the vertical plane when hung on rail 14 is also significantly reduced by the particular configuration selected for the attachment means 13. More particularly, as a result of including the support member 16 in the attachment means 13, the hook 15 now engages the rail 14 at a point or region which is offset from the vertical plane which includes the main member 12. As can be appreciated, such offset of the engagement region acts to compensate for the tendency of the main member 12 to rotate about such vertical plane, the latter rotational tendency being a result of the fabric being hung residing at offset positions along the lower regions of the curved member 22. Preferably, moreover, the length of the support member 16 should be such that the engagement region is offset to such an extent that it lies in the vertical plane defined by the aforesaid lower regions of members 22. In such case, almost total compensation will be realized.

Figure 2:
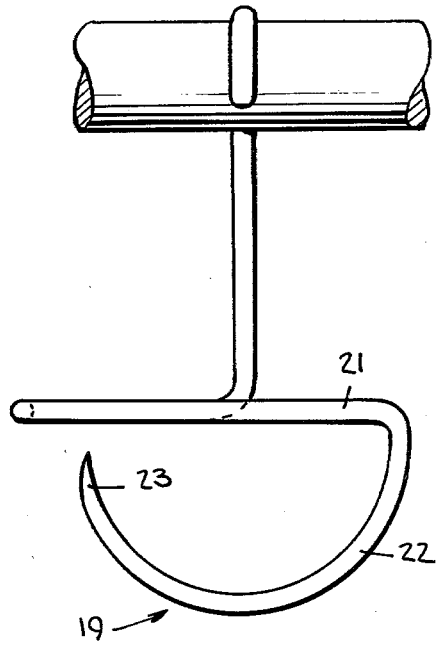
FIG. 2 illustrates an end view of one end of the hanger of FIG. 1.
Figure 3:
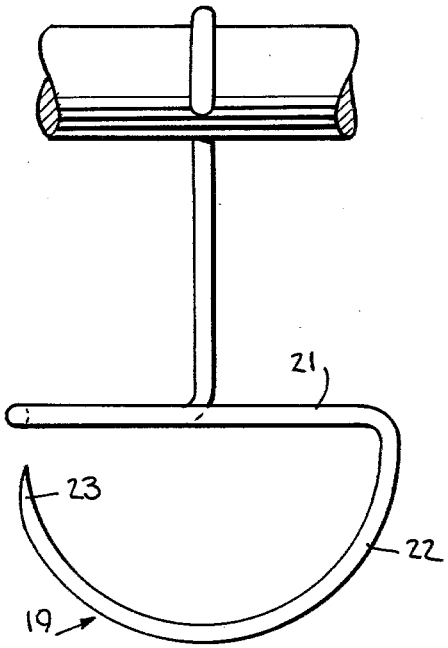
FIG. 3 illustrates an end view of the hanger of FIG. 1 with its securing unit modified from that shown in FIG. 2.

In FIG. 3, the securing units 19 of FIG. 2 have been modified so that the free ends of mounting members 22 are not directed toward and are adjacent to the main member 12. In this embodiment, the main member 12 acts as a shield for the ends 23 in a similar manner as the support member 21 in FIG. 2. In the particular case shown, the free ends of the mounting members 22 are under the main bar 12 at the points of intersection of the main bar and the support members 21.

Figure 4:
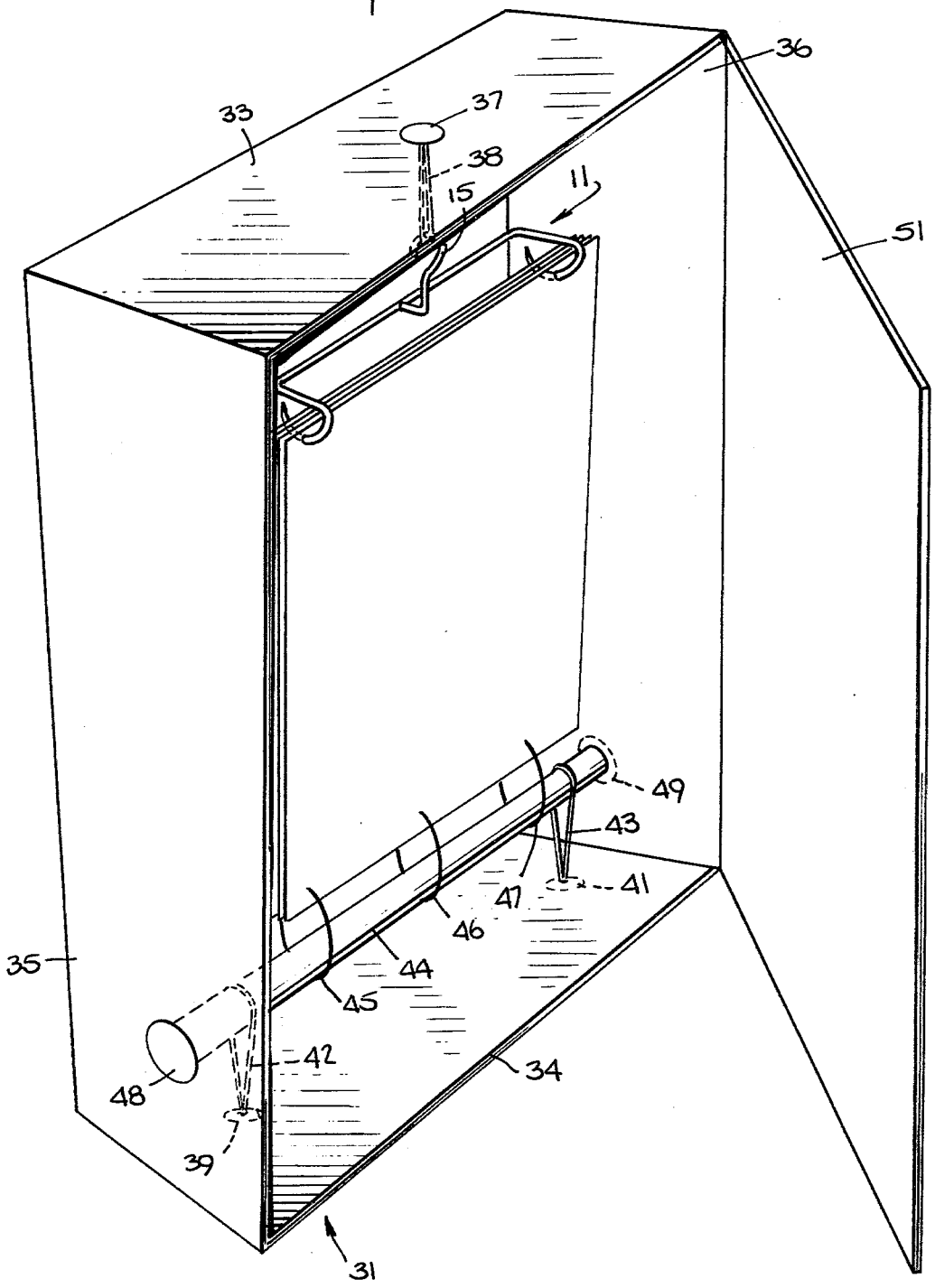
FIG. 4 shows a package which can be employed to transport the hanger in FIG. 1.

In FIG. 4, the hanger 11 of FIG. 1 has been associated with a package 31 for transporting the hanger and the fabric 32 supported thereon such that the latter is not crushed or disturbed during transportation. The package 31 comprises a first set of opposing upper and lower walls 35 and 34 and a second set of opposing side walls 35 and 36 which extend between the aforesaid upper and lower walls.

Affixed to the outer surface of the upper wall 33 is a disc-shaped member or anchor 37 which supports a tie cord 38. The tie cord 38 extends through the wall 33 and adjacent the inner surface of the wall is formed into a loop for engaging the hook 15 of hanger 11.

Affixed to the outer surface of the lower wall 34 are two other disc-like members or anchors 39 and 41, the latter members being similar to the member 37. These members are disposed at opposite longitudinal ends of the wall 34 and each acts as a support for a looped tie cord of similar configuration as tie cord 38. More specifically, member 39 supports a tie cord 42 which extends through wall 34 and adjacent the inner surface thereof is formed into a loop. Likewise, the member 41 supports a similar tie cord 43 which also extends through the wall 34 and is formed into a loop adjacent the inner surface thereof.

Extending from the outer surface of side wall 35 to the outer surface of side wall 36 is a rod 44 which passes through and engages the loop portions of tie cords 42 and 43. The rod 44 additionally passes through a plurality of further looped tie cords 45, 46 and 47 which are symmetrically arranged along and pass through the bottom selvedge of the vertically hung fabric 32. The rod 44 is also provided at its opposite ends, which ends extend beyond the side walls 35 and 36, with cap-like members 48 and 49. These latter members fit over their respective ends of the rod 44 and together prevent any substantial movement of the rod.

As can be appreciated, the rod 44 in conjunction with the tie cords 42 and 43 and the tie cord 38 function to securely hold the hanger 11 and supported fabric 32 within the package 31. In particular, the rod and tie cords place the hanger and fabric combination slightly in tension so that the fabric is suspended within the package 31 in a manner which prevents the fabric from being crushed or bent during transportation or movement of the fabric.

It should be pointed out that the degree of tension exerted on the hanger and fabric may be varied by varying the identical position of the rod 44 and the loops of the tie cords 42 and 43 or by varying the vertical position of the loop of tie cord 38, or by varying both. Furthermore, fabric of different length can be accommodated by similar changes in vertical postion of the bar and tie cords.

It should be also pointed out that in the embodiment of FIG. 4, the tie cords 42 and 43 may be eliminated and the rod 44 supported only by the walls of the package and the cap-like members 48 and 49. Alternatively, the latter cap-like members may be eliminated and the rod supported only by the tie cords 42 and 43.

In order to provide total enclosure of the hanger and fabric, package 31 additionally includes a third set of front and back walls 51 and 52 which extend between the two side walls 35 and 36 and the upper and lower walls 33 and 34. As indicated, front wall 51 is in the form of a cover or flap, being rotatably affixed at one edge to one edge of the side wall 36. This permits the hanger 11 to be readily hung within package 31 and, thereafter, the package to be closed by appropriate sealing of the remaining edges of wall 51 to their corresponding edges of walls 33, 34 and 35.

In placing the hanger 11 and fabric 32 into the package 31, the top selvedge of the fabric is first aligned and fastened together. Two holes are then punched through the fastened top selvedge, these holes being symmetrically situated and spaced aprt by a distance equal to the distance between the pointed ends of the hanger 11. The bottom selvedge is then also fastened and provided with the looped tie cords 45, 46, 47.

Having bound the fabric as aforesaid, the fabric is then fastened onto hanger 11, which is now hanging in package 31 from the looped cord 38, by passing the punched holes over the pointed ends of the securing members. Once the fabric is supported by the hanger, the rod 44 can then be slid through the wall 35, the tie cord 42, the tie cords 45–47, tie cord 43 and the wall 35. The caps 48 and 49 are then placed in position causing the hanger and fabric to be fixedly suspended in the package for safe transportation therein.

Figure 5:
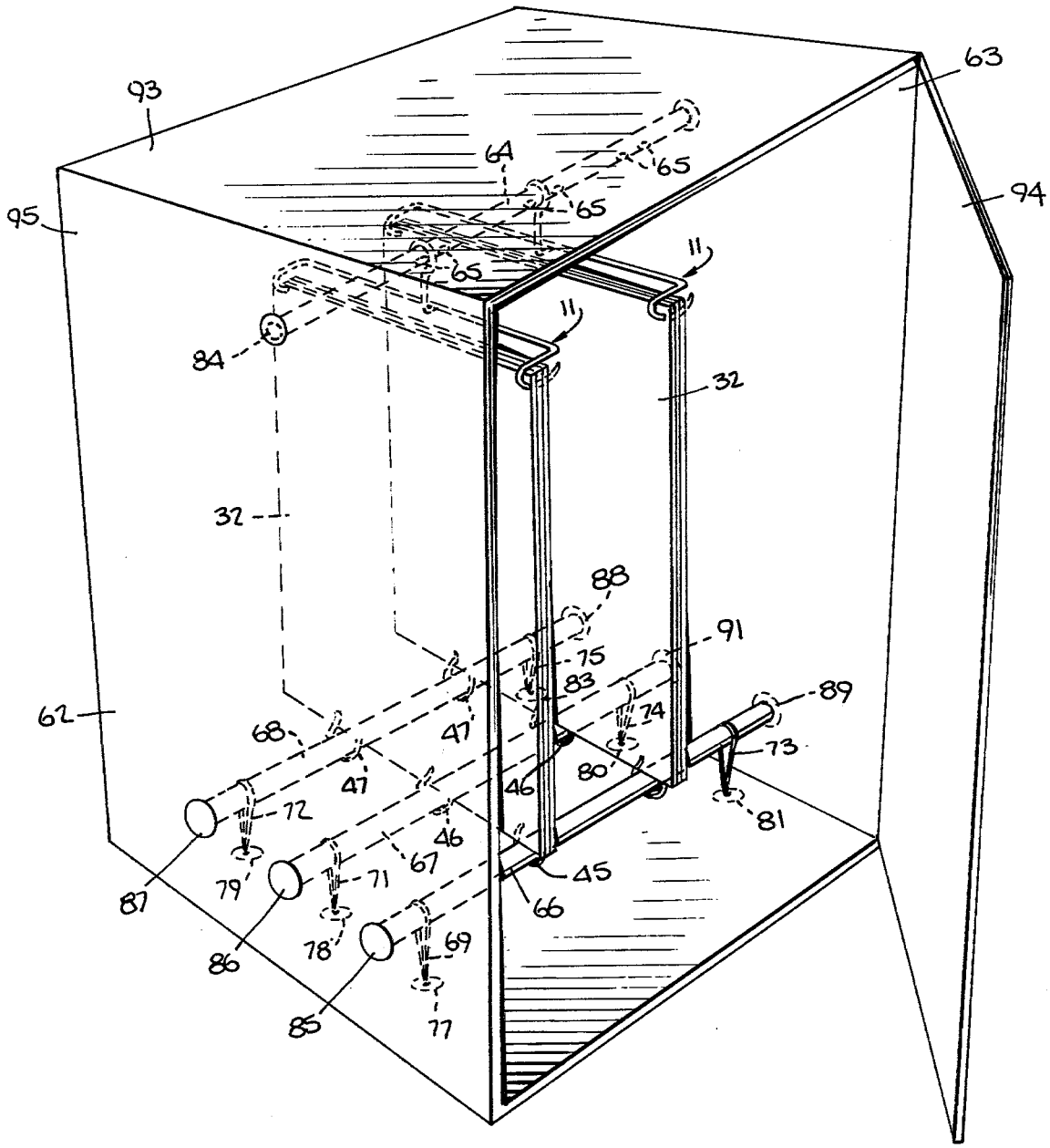
FIG. 5 illustrates a second package which can be employed to transport a plurality of hangers of the type in FIG. 1.

FIG. 5 shows another package 61 which can be used to transport a plurality of hangers 11 carrying vertically held fabric 32. The package 61 also comprises a first set of opposing side walls 62 and 63 between which is disposed a rigid hanger support bar 64. The latter bar has a top surface which has along its length a plurality of spaced protrusions or beads 65. The latter beads serve to maintain the hangers 11 supported on the bar 64 separate from one another, each hanger having its hook situated on the bar between a different pair of beads.

Also disposed between the two side walls, below the bar 64, are a plurality of securing members, shown illustratively as securing bars 66, 67 and 68. The bars 66–68 are situated in the same plane and are spaced apart horizontally so that each bar passes through and engages corresponding ones of the looped tie cords 45, 46 and 47 provided along the bottom selvedge of each of the vertically held lengths of fabric 32. Thus, as shown, the bar 66 passes through the looped tie cords 45, the bar 67, the looped tie cords 46 and the bar 68, the looped tie cords 47.

Each of the bars 66–68 also passes through two further looped tie cords one located adjacent the wall 62 and the other adjacent the wall 63. In particular, tie cords 69, 71 and 72 are arranged adjacent the former wall, while tie cords 73, 74 and 75 are disposed next to the latter wall. As indicated, the bar 66 passes through the tie cords 69 and 73, the bar 67, the tie cords 71 and 74, and the bar 68, the tie cords 72 and 75.

Each of the tie cords 69, 71, 72, 73, 74 and 75 passes through the inner surface of a bottom wall 76 which extends between the side walls 62 and 63. These tie cords are anchored on the outer surface of this bottom wall by disc-like members or anchors 77, 78, 79, 81, 82 and 83, respectively. The bars 66–68 and the bar 64 are also anchored or held, in their case between the walls 62 and 63, by cap-like members which fit over the ends of the bars extending beyond the walls. Thus, cap-like members 84, 85, 86 and 87 secure the ends of the bars 64, 66, 67 and 68 extending beyond wall 62, while cap-like members 88, 89, 91 and 92, respectively, secure the ends of such bars extending beyond surface 63.

As can be appreciated, having arranged package 61 as aforesaid, the package, through the action of the hanger support bar 64 and the securing bars 66–68 and their associated tie cords, will act to place the fabric lengths 32 supported on the hangers slightly in tension so the latter are not crushed or bent during shipment within package 61. Moreover, to further protect such fabric the package 61 is additionally provided with a top wall 93 opposite bottom wall 76 and front and back walls 94 and 95 extending between the two side walls and the bottom and top walls. As in the previous embodiment, the front wall 94 is rotatably affixed to only one edge of side wall 63, so that the hangers 11 can be placed within package 61 and, thereafter, the package sealed by suitably joining the free edges of wall 95 to the walls 93, 62 and 76.

In all cases, it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A hanger for use in hanging fabric comprising:
a longitudinally extending main member;
a first support member connected to one end of said main member at a point of attachment;
a second support member connected to the other end of said main member at a point of attachment;
a first mounting member rigidly connected to said first support member;
a second mounting member rigidly connected to said second support member, said first and second mounting members each extending substantially downwardly from the support member to which it is connected and thereafter upwardly toward the point of attachment of the support member to which it is connected, and said first and second mounting members each terminating in a pointed end portion disposed adjacent to the point of attachment of the support member to which it is connected, whereby the pointed end portion can pierce the fabric and whereby said first and second support members shield the pointed end portions.

2. A hanger for use in hanging fabric comprising:
a longitudinally extending main member;
a first support member connected to one end of said main member;
a second support member connected to the other end of said main member;
a first mounting member rigidly connected to said first support member, said first mounting member extending substantially downwardly from said first support member and then substantially upwardly and terminating in a pointed end portion proximately disposed from said first support member and distally disposed from said main member;

a second mounting member rigidly connected to said second support member, said second mounting member extending substantially downwardly from said second support member and then substantially upwardly terminating in a pointed end portion proximately disposed from said second support member and distally disposed from said main member, whereby the support members shield the pointed end portion.

3. A hanger in accordance with claim 1 or 2 wherein said first and second support members, said first and second mounting members and said main member are integrally formed.

4. A hanger in accordance with claim 1 or 2 wherein said first and second mounting members are curved.

5. A hanger in accordance with claim 1 or 2 further comprising:

means for suspending the hanger;

an offset member, one end of which is affixed to said main member and the other end of which is affixed to said means for suspending at a suspension point, said offset member being of a predetermined length so that the center of gravity of the fabric and the point of suspension lie in a substantially vertical plane, whereby the fabric is balanced on said hanger.

6. A hanger in accordance with claim 5 wherein:

said offset member is a rigid rod and is secured to the midpoint of said main member, and said means for suspending is a hook having its lower extremity affixed to said rod.

7. A hanger in accordance with claim 1 or 2 further comprising:

said first and second mounting members each having a minimum point where the direction of the mounting member changes from downwardly to upwardly; and means for suspending the hanger, said means for suspending attached to said main member and having a point of suspension which lies in a substantially vertical plane with the minimum points of the mounting members, whereby the fabric supported at the minimum points of the mounting members is balanced with respect to the point of suspension.

* * * * *

UNITED STATES PATENT AND TRADEMARK OFFICE

CERTIFICATE OF CORRECTION

PATENT NO. : 4 193 504

DATED : March 18, 1980

INVENTOR(S) : Milton Berkowitz

It is certified that error appears in the above-identified patent and that said Letters Patent are hereby corrected as shown below:

Column 4, line 22, delete "...lower walls 35..."
and substitute --...lower walls 33...--

Column 4, line 65, delete "... the identical position..."
and substitute --the vertical position---

Signed and Sealed this

*Third* Day of *February 1981*

[SEAL]

*Attest:*

RENE D. TEGTMEYER

*Attesting Officer*

*Acting Commissioner of Patents and Trademarks*